US010173820B2

(12) United States Patent
Patwardhan

(10) Patent No.: US 10,173,820 B2
(45) Date of Patent: Jan. 8, 2019

(54) CARTON AND CARTON BLANK

(71) Applicant: WestRock Packaging Systems, LLC, Norcross, GA (US)

(72) Inventor: Tanuja A. Patwardhan, Smyrna, GA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/552,379

(22) PCT Filed: Feb. 18, 2016

(86) PCT No.: PCT/US2016/018422
§ 371 (c)(1),
(2) Date: Aug. 21, 2017

(87) PCT Pub. No.: WO2016/134118
PCT Pub. Date: Aug. 25, 2016

(65) Prior Publication Data

US 2018/0044086 A1 Feb. 15, 2018

Related U.S. Application Data

(60) Provisional application No. 62/118,747, filed on Feb. 20, 2015.

(51) Int. Cl.
*B65D 71/36* (2006.01)
*B65D 5/72* (2006.01)
(Continued)

(52) U.S. Cl.
CPC ..... *B65D 71/36* (2013.01); *B65D 5/0227* (2013.01); *B65D 5/4608* (2013.01); *B65D 5/541* (2013.01);
(Continued)

(58) Field of Classification Search
CPC ..... B65D 71/36; B65D 5/725; B65D 5/541; B65D 2571/0058; B65D 5/5405; B65D 5/703; B65D 5/0227
(Continued)

(56) References Cited

U.S. PATENT DOCUMENTS 3,735,914 A 5/1973 Collura et al.
4,378,877 A 4/1983 Botterman
(Continued)

*Primary Examiner* — Steven A. Reynolds
(74) *Attorney, Agent, or Firm* — WestRock Intellectual Property Group

(57) ABSTRACT

A carton includes panels for forming a tubular structure. The panels include a top panel (16), a base panel (12) and a pair of first and second opposed side panels (14, 18) hingedly interconnecting the top and base panels. The carton includes at least one end closure panel (24*b*, 28*b*) forming an end wall which at least partially closes a first end of the tubular structure. The carton includes a dispenser for facilitating access to the carton contents. The dispenser includes a first severance line (76) and a second severance line (84) each defined in one (16) of the panels forming the tubular structure. A third severance line (60) and a fourth severance line (70) are each defined in the end wall. The first and second severance line are divergently arranged with respect to each other. The third and fourth severance line are divergently arranged with respect to each other.

7 Claims, 5 Drawing Sheets

(51) Int. Cl.
*B65D 5/02* (2006.01)
*B65D 5/468* (2006.01)
*B65D 5/54* (2006.01)

(52) U.S. Cl.
CPC ..... *B65D 5/725* (2013.01); *B65D 2571/0058* (2013.01); *B65D 2571/0066* (2013.01); *B65D 2571/00141* (2013.01); *B65D 2571/00444* (2013.01); *B65D 2571/00728* (2013.01)

(58) Field of Classification Search
USPC ..... 206/427; 229/242, 122, 122.1; 221/305
See application file for complete search history.

(56) References Cited

U.S. PATENT DOCUMENTS

| | | | | |
|---|---|---|---|---|
| 7,328,798 | B2 * | 2/2008 | Auclair | B65D 71/36 206/427 |
| 7,614,543 | B1 | 11/2009 | Miller | |
| 8,127,924 | B2 * | 3/2012 | Harrelson | B65D 5/725 206/427 |
| 8,646,645 | B1 | 2/2014 | Miller | |
| 2004/0089671 | A1 | 5/2004 | Miller | |
| 2004/0155098 | A1 * | 8/2004 | Harrelson | B65D 5/725 229/122 |
| 2004/0232214 | A1 * | 11/2004 | Bates | B65D 5/725 229/122.1 |
| 2006/0081492 | A1 | 4/2006 | Holley | |

* cited by examiner

CARTON AND CARTON BLANK

CROSS-REFERENCE TO RELATED APPLICATIONS

This application is a National Phase application of PCT Application PCT/US16/18422, filed Feb. 18, 2016, which claims the benefit of U.S. Provisional Patent Application No. 62/118747, filed Feb. 20, 2015, both of which are incorporated herein by reference in their entirety,

TECHNICAL FIELD

The present invention relates to a carton and blank for forming the same more specifically, but not exclusively, to a carton comprising a dispenser for facilitating access to the contents of the carton.

BACKGROUND

In the field of packaging it is often required to provide consumers with a package comprising multiple primary product containers. Such multi-packs are desirable for shipping and distribution purposes and for the display of promotional information. For cost and environmental considerations, such cartons or carriers need to be formed from as little material as possible and cause as little wastage as possible in the materials from which they are formed. Another consideration is the strength of the packaging and its suitability for holding and transporting large weights of articles.

It is desirable to provide a carton comprising a dispenser for facilitating access to the contents of the carton.

The present invention seeks to overcome or at least mitigate the problems of the prior art.

SUMMARY

According to a first aspect of the present invention there is provided a carton for packaging one or more articles. The carton comprises a plurality of panels for forming a tubular structure. The plurality of panels comprises a top panel, a base panel and a pair of first and second opposed side panels hingedly connected to first and second opposite sides of the top and base panels respectively. The carton comprises at least one end closure panel forming an end wall which at least partially closes a first end of the tubular structure. The carton comprises a dispenser for facilitating access to the carton contents. The dispenser comprises a first severance line and a second severance line each defined in one of the plurality of panels forming the tubular structure and a third severance line and a fourth severance line each defined in the end wall. The first and second severance lines are divergently arranged with respect to each other. The third and fourth severance lines are divergently arranged with respect to each other.

Optionally, the first severance line and the third severance line intersect at a first corner of the one of the plurality of panels forming the tubular structure and the second severance line and the fourth severance line intersect at a second corner of the one of the plurality of panels forming the tubular structure.

Optionally, the first severance line and the third severance line converge at a first corner of the one of the plurality of panels forming the tubular structure and the second and fourth severance line converge at a second corner of the one of the plurality of panels forming the tubular structure.

Optionally, the first severance line extends from the first corner and is divergently arranged with respect to the hinged connection between the top panel and the first side panel, the second severance line extends from the second corner and is divergently arranged with respect to the hinged connection between the top panel and the second side panel.

Optionally, the carton comprises a first end closure panel hinged to the first side panel, the third severance line extends from a vertex defined by the hinged connection between the first end closure panel and the first side panel and the hinged connection between the top panel and the first side panel, and the third severance line is divergently arranged with respect to the hinged connection between the first end closure panel and the first side panel.

Optionally, the carton comprises a second end closure panel hinged to the second side panel, the fourth severance line extends from a vertex defined by the hinged connection between the second end closure panel and the second side panel and the hinged connection between the top panel and the second side panel, and the fourth severance line is divergently arranged with respect to the hinged connection between the second end closure panel and the second side panel.

According to a second aspect of the present invention there is provided a carton for packaging one or more articles. The carton comprises a plurality of panels for forming a tubular structure. The plurality of panels comprises a top panel and a first side panel hingedly connected to a first side of the top panel. The carton comprises a dispenser for facilitating access to the contents of the carton. The dispenser comprises a detachable portion defined at least in part by a first severance line defined in the top panel. The first severance line is divergently arranged with respect to the hinged connection between the top panel and the first side panel. The dispenser further comprises a second severance line extending between the first severance line and the hinged connection between the top panel and the first side panel. The first and second severance lines define in part a first portion of the top panel hingedly connected to the first side panel. The detachable portion defines an opening in the carton. The first portion is foldable with respect to the first side panel when the detachable portion is removed from the top panel such that an article can be withdrawn from the carton.

Optionally, the carton comprises a second side panel hingedly connected to a second side of the top panel and the dispenser comprises a third severance line defined in the top panel, the third severance line is divergently arranged with respect to the hinged connection between the top panel and the second side panel, the dispenser further comprises a fourth severance line extending between the third severance line and the hinged connection between the top panel and the second side panel, the third and fourth severance lines define in part a second portion of the top panel hingedly connected to the second side panel, and the second portion is foldable with respect to the second side panel when the detachable portion is removed from the top panel thereby enabling an article to be withdrawn from the carton.

Optionally, the carton comprises at least one end closure panel forming an end wall which at least partially closes a first end of the tubular structure, the dispenser comprises a fifth severance line and a sixth severance line each defined in the end wall and defining in part the detachable portion, the fifth severance line and the sixth severance line are divergently arranged with respect to each other.

According to a third aspect of the present invention there is provided a carton for packaging one or more articles. The carton comprises a plurality of panels for forming a tubular structure. The plurality of panels comprises a top panel and a pair of first and second opposed side panels hingedly connected to first and second opposite sides of the top panel respectively. The carton comprises a dispenser for facilitating access to the carton contents. The dispenser comprises a detachable portion defined at least in part by a first severance line and a second severance line each defined in the top panel. The first severance line is divergently arranged with respect to the hinged connection between the top panel and the first side panel. The second severance line is divergently arranged with respect to the hinged connection between the top panel and the second side panel. The dispenser further comprises a third severance line extending between the first severance line and the hinged connection between the top panel and the first side panel and a fourth severance line extending between the second severance line and the hinged connection between the top panel and the second side panel. The first and third severance lines define in part a first portion of the top panel hingedly connected to the first side panel. The second and fourth severance lines define in part a second portion of the top panel hingedly connected to the second side panel. The detachable portion defines an opening in the carton. The first and second portions are foldable with respect to the respective the one of the first and second side panels to which they are hinged when the detachable portion is removed from the top panel such that an article can be withdrawn from the carton.

According to a fourth aspect of the present invention there is provided a blank for forming a carton. The blank comprises a plurality of panels for forming a tubular structure. The plurality of panels comprises a top panel, a base panel and a pair of first and second opposed side panels. The blank comprises at least one end closure panel for forming an end wall which in a set-up carton at least partially closes a first end of the tubular structure. The blank comprises a dispenser for facilitating access to an interior of the set-up carton. The dispenser comprises a first severance line and a second severance line each defined in one of the plurality of panels forming the tubular structure and a third severance line and a fourth severance line each defined in the end wall. The first and second severance lines are divergently arranged with respect to each other. The third and fourth severance lines are divergently arranged with respect to each other.

Optionally, the first severance line and the third severance line intersect at a first corner of the one of the plurality of panels forming the tubular structure and the second and fourth severance lines intersect at a second corner of the one of the plurality of panels forming the tubular structure.

Optionally, the first severance line and the third severance line converge at a first corner of the one of the plurality of panels forming the tubular structure and the second and fourth severance lines converge at a second corner of the one of the plurality of panels forming the tubular structure.

According to a fifth aspect of the present invention there is provided a blank for forming a carton. The blank comprises a plurality of panels for forming a tubular structure. The plurality of panels comprises a top panel and a first side panel hingedly connected to the top panel. The blank comprises a dispenser for facilitating access to an interior of a set-up carton. The dispenser comprises a detachable portion defined at least in part by a first severance line defined in the top panel. The first severance line is divergently arranged with respect to the hinged connection between the top panel and the first side panel. The dispenser further comprises a second severance line extending between the first severance line and the hinged connection between the top panel and the first side panel. The first and second severance lines define in part a first portion of the top panel hingedly connected to the first side panel. The detachable portion defines an opening in the set-up carton. The first portion is foldable with respect to the first side panel when the detachable portion is removed from the top panel of the set-up carton such that an article can be withdrawn from the carton.

According to a sixth aspect of the present invention there is provided a blank for forming a carton. The blank comprises a plurality of panels for forming a tubular structure. The plurality of panels comprises a top panel and a pair of first and second opposed side panels hingedly connected to first and second opposite sides of the top panel respectively. The blank comprises a dispenser for facilitating access to an interior of a set-up carton. The dispenser comprises a detachable portion defined at least in part by a first severance line and a second severance line each defined in the top panel. The first severance line is divergently arranged with respect to the hinged connection between the top panel and the first side panel. The second severance line is divergently arranged with respect to the hinged connection between the top panel and the second side panel. The dispenser further comprises a third severance line extending between the first severance line and the hinged connection between the top panel and the first side panel and a fourth severance line extending between the second severance line and the hinged connection between the top panel and the second side panel. The first and third severance lines define in part a first portion of the top panel hingedly connected to the first side panel. The second and fourth severance lines define in part a second portion of the top panel hingedly connected to the second side panel. The detachable portion defines an opening in the set-up carton. The first and second portion are configured to be foldable with respect to the respective one of the first and second side panels to which they are hinged when in the set-up carton the detachable portion is removed from the top panel thereby allowing an article to be withdrawn from the carton.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
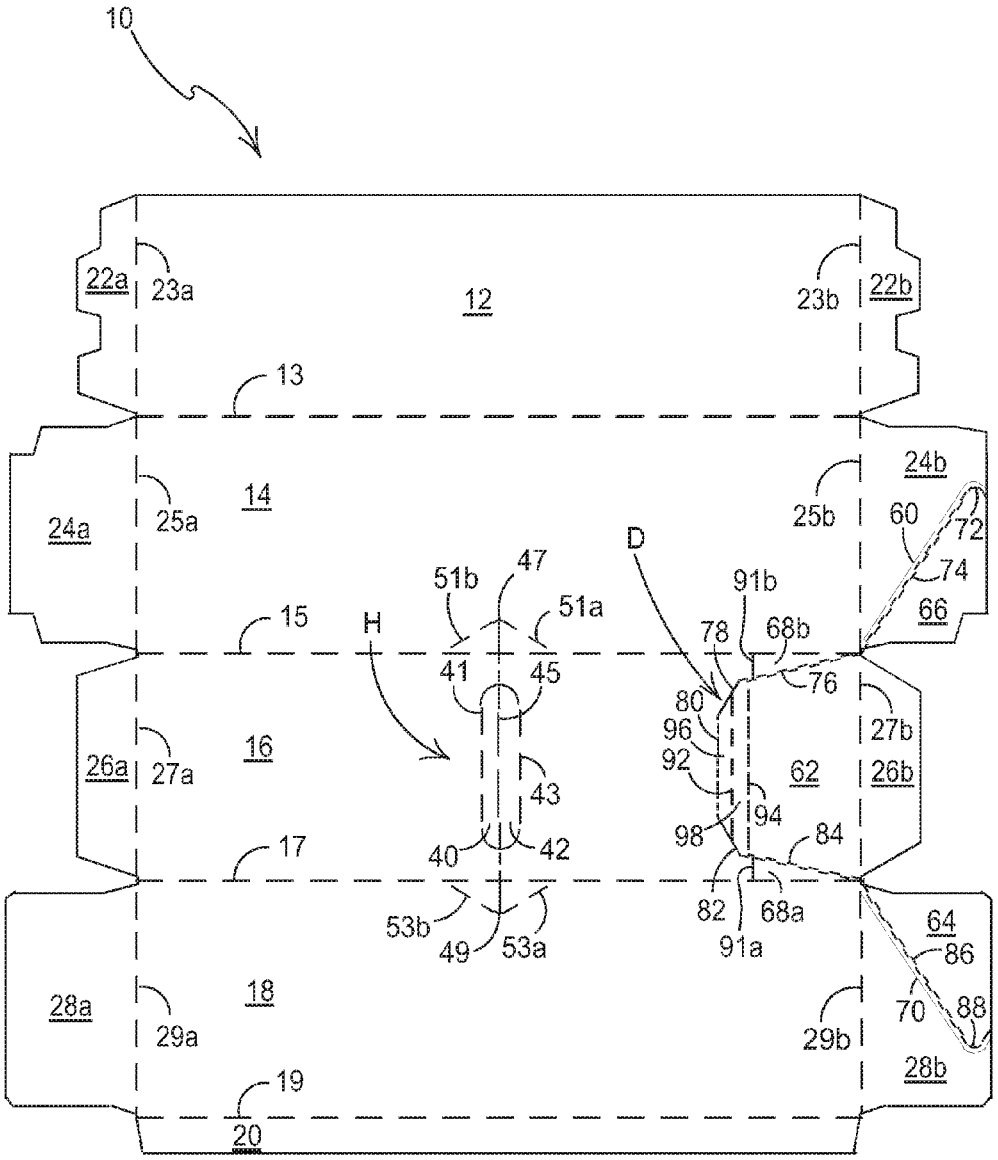
FIG. 1 is a plan view from above of a blank for forming a carton according to an embodiment of the invention.
Figure 2:
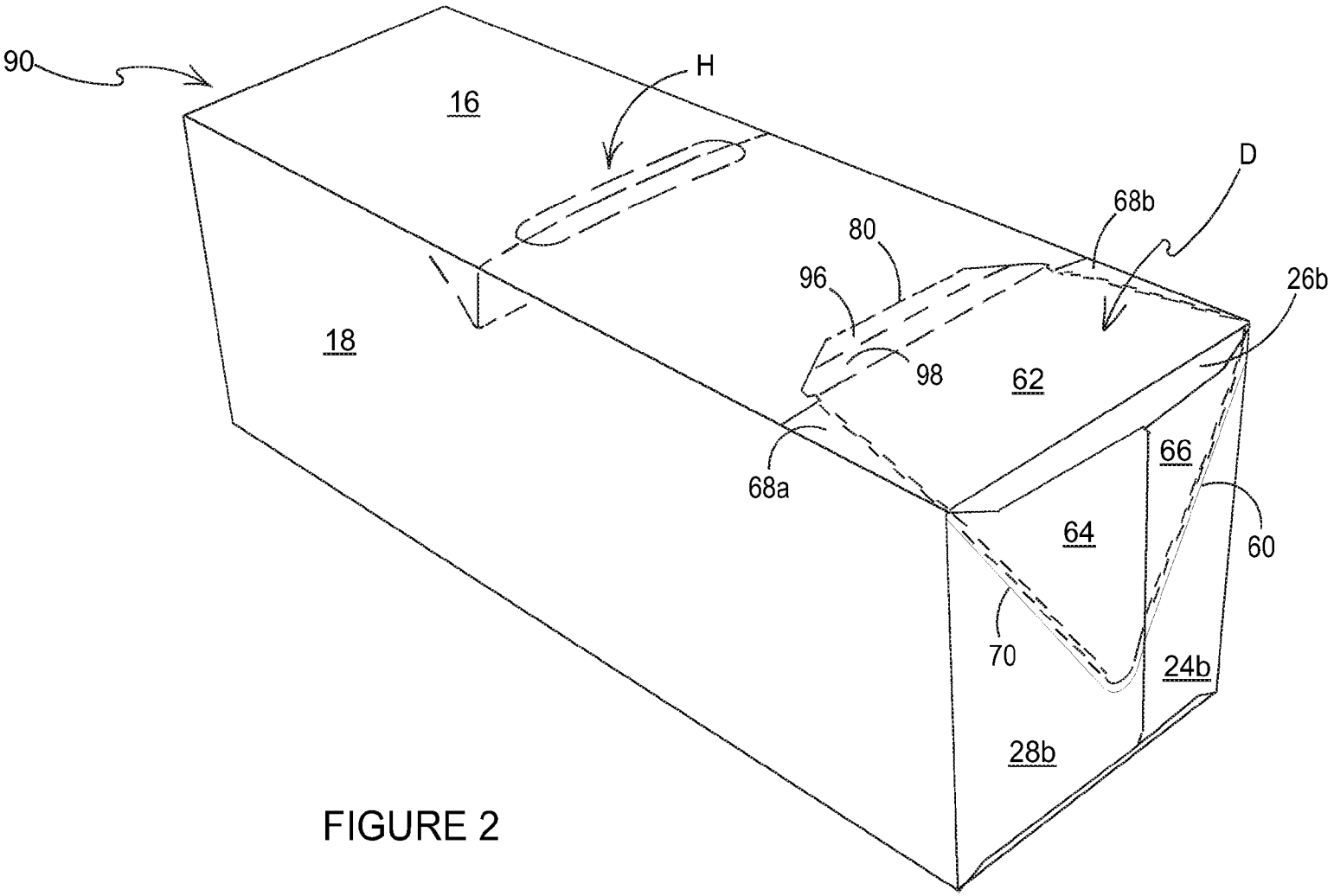
FIG. 2 is a perspective view from above of a carton formed from the blank of FIG. 1.

Referring to FIGS. 1 and 2 there is shown a blank 10 for forming a carton 90 capable of accepting an input of primary products such as, but not limited to, bottles or cans, hereinafter referred to as articles A.

The blank 10 comprises a plurality of main panels 12, 14, 16, 18, 20, hinged one to the next in a linear series. A base panel 12 is hinged to a first side wall panel 14 by a hinged connection such as a fold line 13. A first side wall panel 14 is hinged to a top panel 16 by a hinged connection such as a fold line 15. A top panel 16 is hinged to second side wall panel 18 by a hinged connection such as a fold line 17. A second side wall panel 18 is hinged to a glue panel 20 by a hinged connection such as a fold line 19.

The plurality of main panels 12, 14, 16, 18, 20 of the blank 10 form walls of an open ended tubular structure in a set-up condition. The tubular structure is at least partially closed by end closure structures. The tubular structure has a tubular axis defining a longitudinal direction.

Each of the ends of the tubular structure is at least partially closed by end closure panels which form end walls of the tubular structure. In the illustrated embodiment the ends of the tubular structure are fully closed by end closure panels 22*a*, 24*a*, 26*a*, 28*a*, 22*b*, 24*b* 26*b*, 28*b*.

End closure panels 22*a*, 24*a*, 26*a*, 28*a* are configured to close a first end of the tubular structure and end closure panels 22*b*, 24*b*, 26*b*, 28*b* are configured to close a second end of the tubular structure.

The first end of the tubular structure is closed by a first end closure panel 22*a*, a second end closure panel 24*a*, a third end closure panel 26*a* and a fourth end closure panel 28*a*. The first end closure panel 22*a* is hinged to a first end of the base panel 12 by a hinged connection such as a fold line 23*a*. The second end closure panel 24*a* is hinged to a first end of the first side wall panel 14 by a hinged connection such as a fold line 25*a*. The third end closure panel 26*a* is hinged to a first end of the top panel 16 by a hinged connection such as a fold line 27*a*. The fourth end closure panel 28*a* is hinged to a first end of the second side wall panel 18 by a hinged connection such as a fold line 29*a*.

The second end of the tubular structure is closed by a fifth end closure panel 22*b*, a sixth end closure panel 24*b*, seventh end closure panel 26*b* and an eighth end closure panel 28*b*. The fifth end closure panel 22*b* is hinged to a second end of the base panel 12 by a hinged connection such as a fold line 23*b*. The sixth end closure panel 24*b* is hinged to a second end of the first side wall panel 14 by a hinged connection such as a fold line 25*b*. The seventh end closure panel 26*b* is hinged to a second end of the top panel 16 by a hinged connection such as a fold line 27*b*. The eighth end closure panel 28*b* is hinged to a second end of the second side wall panel 18 by a hinged connection such as a fold line 29*b*.

The first end closure panel 22*a* and the fifth end closure panel 22*b* each form a minor lower end closure panel at opposing ends of the tubular structure. The third end closure panel 26*a* and the seventh end closure panel 26*b* each form a minor upper end closure panel at opposing ends of the tubular structure.

The second end closure panel 24*a* and the fourth end closure panel 28*a* each form a major side end closure panel at the first end of the tubular structure. The sixth end closure panel 24*b* and the eighth end closure panel 28*b* each form a major side end closure panel at the second end of the tubular structure.

Optionally, the top panel 16 comprises a carrying handle H which comprises a pair of elongate tabs 40, 42 which are defined in part by a severance line 45. The severance line 45 extends transversely across the top wall panel 16 and into each of the first and second side wall panels 14, 18. A first elongate tab 40 is defined in part by a first fold line 41, which is disposed in a spaced apart parallel relationship to the severance line 45. A second elongate tab 42 is defined in part by a second fold line 43 which is disposed in a spaced apart parallel relationship to the severance line 45. The first and second fold lines 41, 43 are disposed on opposing sides of the severance line 45. A first arcuate cutline defines the first ends of each of the first and second elongate tabs 40, 42. The first arcuate cutline extends between a first end of the first fold line 41 and a first end of the second fold line 43, across the severance line 45. A second arcuate cutline defines second ends of each of the first and second elongate tabs 40, 42. The second arcuate cutline extends between a second end of the first fold line 41 and a second end of the second fold line 43, across the severance line 45.

The handle structure H comprises a pair of fold or crease lines 51*a*, 51*b* at a first end of the severance line 45. The first end of the severance line 45 is disposed in the first side wall panel 14 and terminates in a "V" shaped cutline 47, wherein each of the arms of the "V" shaped cutline 47 form a vertex, the vertex being disposed at the first end of the severance line 45. The pair of fold or crease lines 51*a*, 51*b* comprise a first crease line 51*a* and a second crease line 51*b*; the first and second crease lines 51*a*, 51*b* are formed continuously with the "V" shaped cutline 47 from opposing ends thereof.

The handle structure H comprises a second pair of fold or crease lines 53*a*, 53*b* at a second end of severance line 45. The second end of the severance line 45 is disposed in the second side wall panel 18 and terminates in a "V" shaped cutline 49 wherein each of the arms of the "V" shaped cutline 49 form a vertex, the vertex being disposed at the second end of the severance line 45. The second pair of fold or crease lines 53*a*, 53*b* comprise a third crease line 53*a* and a fourth crease line 53*b*; the third and fourth crease lines 53*a*, 53*b* are formed continuously with the "V" shaped cutline 49 from opposing ends thereof.

In alternative embodiments the handle structure may be omitted or alternative handle structures may be employed.

The blank 10 comprises a dispenser D for facilitating access to the contents of the carton 90. The dispenser D comprises a removable corner portion of the carton 90. The dispenser D comprises a plurality of severance lines 60, 70, 74, 76, 78, 80, 82, 84, 86.

The sixth end closure panel 24*b* comprises a first severance line 74 extending from a free end edge of sixth end closure panel 24*b* to the vertex between fold line 15 and fold line 23*b*. The first severance line 74 comprises an arcuate portion 72 proximate the free end edge of sixth end closure panel 24*b*. The arcuate portion 72 is optionally substantially "U" shaped or "V" shaped. A second severance line 76 is defined in the top panel 16 and extends from the vertex between fold line 15 and fold line 23*b* into the top panel 16. The second severance line 76 is arranged divergently with respect to the fold line 15. A third severance line 78 is defined in the top panel 16 and extends from the second severance line 76. The third severance line 78 is divergently arranged with respect to the second severance line 76. A fourth severance line 80 extends transversely substantially across the top panel 16. A fifth severance line 82 is defined in the top panel 16 and extends from the fourth severance line 80. The fifth severance line 82 is divergently arranged with respect to the fourth severance line 80. A sixth severance line 84 extends from the fifth severance line 82 to the vertex between the fold line 17 and the fold line 27*b*. The sixth severance line 84 is arranged divergently with respect to the fold line 17. The eighth end closure panel 28*b* comprises a seventh severance line 86 which extends from the vertex between fold line 17 and fold line 29*b* to a free end edge of eighth end closure panel 28*b*. The seventh severance line 86 comprises an arcuate portion 88 proximate the free end edge of eighth end closure panel 28*b*. The arcuate portion 88 is optionally substantially "U" shaped or "V" shaped. In this way the plurality of severance lines 60, 70, 74, 76, 78, 80, 82, 84, 86 are continuous and are arranged to form a continuous loop in a set-up carton 90.

The first, second, sixth and seventh severance lines 74, 76, 84, 86 are arranged so as to be divergent with respect to a longitudinal direction (defined by fold lines 13, 15, 17, 19) of the blank 10. The first, second, sixth and seventh severance lines 74, 76, 84, 86 are arranged so as to be divergent with respect to a transverse direction (defined by fold lines 23*b*, 25 *b*, 27 *b*, 29 *b*) of the blank 10. In this way when the blank is formed from a material having a grain direction in either the longitudinal direction or the transverse direction the first, second, sixth and seventh severance lines 74, 76, 84, 86 allows traverse at least in part across the grain direction.

It will also be appreciated that none of the plurality of severance lines 60, 70, 74, 76, 78, 80, 82, 84, 86 extend along any of the hinged connections between the panels of the blank 10. That is to say the plurality of severance lines 60, 70, 74, 76, 78, 80, 82, 84, 86 are not coincident with any of the hinged connections between the panels of the blank 10.

The dispenser D may comprise a tear initiation device in the form of a first tab 96 defined in part by the fourth severance line 80 and by a first fold line 92. First fold line 92 extends between the third severance line 78 and the fifth severance line 82. First fold line 92 is substantially parallel to the fourth severance line 80. The tear initiation device may comprise a second tab 98 hingedly coupled to the first tab 96 by the first fold line 92 and to a detachable portion 62 of the top panel 16 by a second fold line 94.

First severance line 74 defines a detachable portion 66 of the sixth end closure panel 24*b*. Seventh severance line 86 defines a detachable portion 64 of the eighth end closure panel 28*b*.

The dispenser D comprises an eighth severance line 60 defined in the sixth end closure panel 24*b*. The eighth severance line 60 is shaped similarly to the first severance line 74. The eighth severance line 60 is spaced apart or offset from the first severance line 74. The eighth severance line 60 is a partial depth severance line.

The dispenser D comprises a ninth severance line 70 defined in the eighth end closure panel 28*b*. The ninth severance line 70 is shaped similarly to the seventh severance line 86. The ninth severance line 70 is spaced apart or offset from the seventh severance line 86. The ninth severance line 70 is a partial depth severance line.

The top panel 16 comprises a tenth severance line 91*a* and an eleventh severance line 91*b*. The tenth severance line 91*a* extends between the fold line 17 and the sixth severance line 84. The eleventh severance line 91*b* extends between the fold line 15 and the second severance line 76.

The tenth severance line 91*a* defines in part a first portion 68*a* of the top panel 16 which is foldable about the fold line 17 when the detachable portion 62 has been removed. The eleventh severance line 91*b* defines in part a second portion 68*b* of the top panel 16 which is foldable about the fold line 15 when the detachable portion 62 has been removed.

The carton 90 can be formed by a series of sequential folding operations in a straight line machine so that the carton 90 may not be required to be rotated or inverted to complete its construction. The folding process is not limited to that described below and may be altered according to particular manufacturing requirements. During loading and assembly of the carton 90, the carton 90 may be orientated such that one of the first and second side panels 14, 18 forms a loading surface. The bases of one or more articles A may be in sliding contact with the loading surface when being inserted into the carton 90. The articles A may be substantially cylindrical in shape and have a cylindrical axis. The cylindrical axis is orientated perpendicularly to the first side panel 14 and may also be orientated substantially vertically.

The main panel 16 forms the top panel (top wall) 16 when the handle structure H is in use as a carrying handle by a user and this top wall 16 is optionally, disposed adjacent to the sides of the articles A. In this orientation the top wall 16 is not disposed substantially planar to the tops or bottoms of the articles A held within the carton 90 In other words the cylindrical axis of the articles A is substantially parallel with the plane of the top wall 16 of the carton 90.

The main panel 12 forms the base panel 12 when the handle structure H is in use as a carrying handle by a user. The main panel 12 may also form the base panel 12 when the articles A are being dispensed from the carton 90 or when the carton 90 is at rest upon a surface such as a shelf. As such, it will be understood that descriptive terms "top", "base", and "side" do not necessarily limit the carton 90 to adopting a particular orientation but serve to distinguish those panels from one another. In other embodiments the cylindrical axis of the articles A may be orientated differently with respect to the top wall 16 of the carton 90. For example, but not limited to, the cylindrical axis of the articles A be may orientated substantially perpendicularly to the plane of the top wall 16 of the carton 90.

Turning to the construction of the carton 90 as illustrated in FIGS. 2 to 5, the blank 10 is folded about the fold line 17 such that the second side panel 18 is disposed in overlying relationship with the top panel 16 and such that the securing panel 20 is disposed in face contacting relationship with the first side panel 14.

Glue G or other adhesive treatment is applied to an outer surface of the securing panel 20. Alternatively, glue G or other adhesive treatment may be applied to a corresponding edge portion of an inner surface of the base panel 12.

The blank 10 is folded about the fold line 13 such that the base panel 12 is disposed in overlying relationship with the securing panel 20 and part of the first side panel 14. The base panel 12 is thereby secured to the securing panel 20.

The blank 10 is thus formed into a flat collapsed tubular structure which can be readily shipped or distributed to a convertor plant, at which the flat collapsed tubular structure may be erected into an open ended tubular structure and loaded with articles A.

The flat collapsed tubular structure may be erected to form an open ended tubular structure by unfolding the first side panel 14 with respect to the base panel 12 such that the first side panel 14 is disposed substantially perpendicularly with respect to the base panel 12.

The carton 90, in its open ended tubular form, may be loaded with articles A through one or both open ends thereof. It will be appreciated that in some embodiments one of the open ends of the carton 90 may be closed before loading the interior with articles A through the remaining open end.

Once the carton 90 has been loaded with articles A the open ends of the carton 90 are closed.

The method for closing each of the open ends of the carton 90 is substantially the same and will be described by reference to closing the first open end.

A first end of the tubular structure is closed by folding the first end closure panel 22*a* about fold line 23*a* and by folding the third end closure panel 26*a* about fold line 27*a*.

Glue or other adhesive treatment may be applied to a first portion of an inner surface of the second end closure panel 24*a*. In alternative embodiments glue or other adhesive treatment may be applied to a corresponding portion of an outer surface of first end closure panel 22*a*.

Glue or other adhesive treatment may be applied to a second portion of an inner surface of the second end closure panel 24*a*. In alternative embodiments glue or other adhesive treatment may be applied to a corresponding portion of an outer surface of third end closure panel 26*a*.

The second end closure panel 24*a* is then folded about the fold line 25*a* to be brought into contact with the first and third end closure panels 22*a*, 26*a*. The second end closure panel 24*a* may be secured to each of the first and third end closure panels 22*a*, 26*a*.

Glue or other adhesive treatment is applied to a portion of an inner surface of the fourth end closure panel 28*a*. In alternative embodiments glue or other adhesive treatment may be applied to a portion of an outer surface of the second end closure panel 24*a*.

The fourth end closure panel 28*a* is then folded about the fold line 29*a* to be brought into contact with the second end closure panel 24*a* and optionally into contact with the first and third end closure panels 22*a*, 26*a*.

The fourth end closure panel 28*a* is secured to the second end closure panel 24*a*. The fourth end closure panel 28*a* may be secured to the first and third end closure panels 22*a*, 26*a*, for example by glue or other adhesive treatment.

In alternative embodiments the second end closure panel 24*a* may be folded about fold line 25*a* after folding the fourth end closure panel 28*a* about fold line 29*a*. It will be appreciated that in such embodiments the second end closure panel 24*a* is disposed outermost.

In other embodiments alternative securing means may be employed to secure the end closure panels 22*a*, 24*a*, 26*a*, 28*a*, 22*b*, 24*b*, 26*b*, 28*b* for example, but not limited to, mechanical locking devices such as staples or punch locks integrally formed within the end closure panels 22*a*, 24*a*, 26*a*, 28*a*; 22*b*, 24*b*, 26*b*, 28*b*.

The process described above in relation to the first end is replicated to close the second end of the carton 90 and is not further described.

Figure 3:
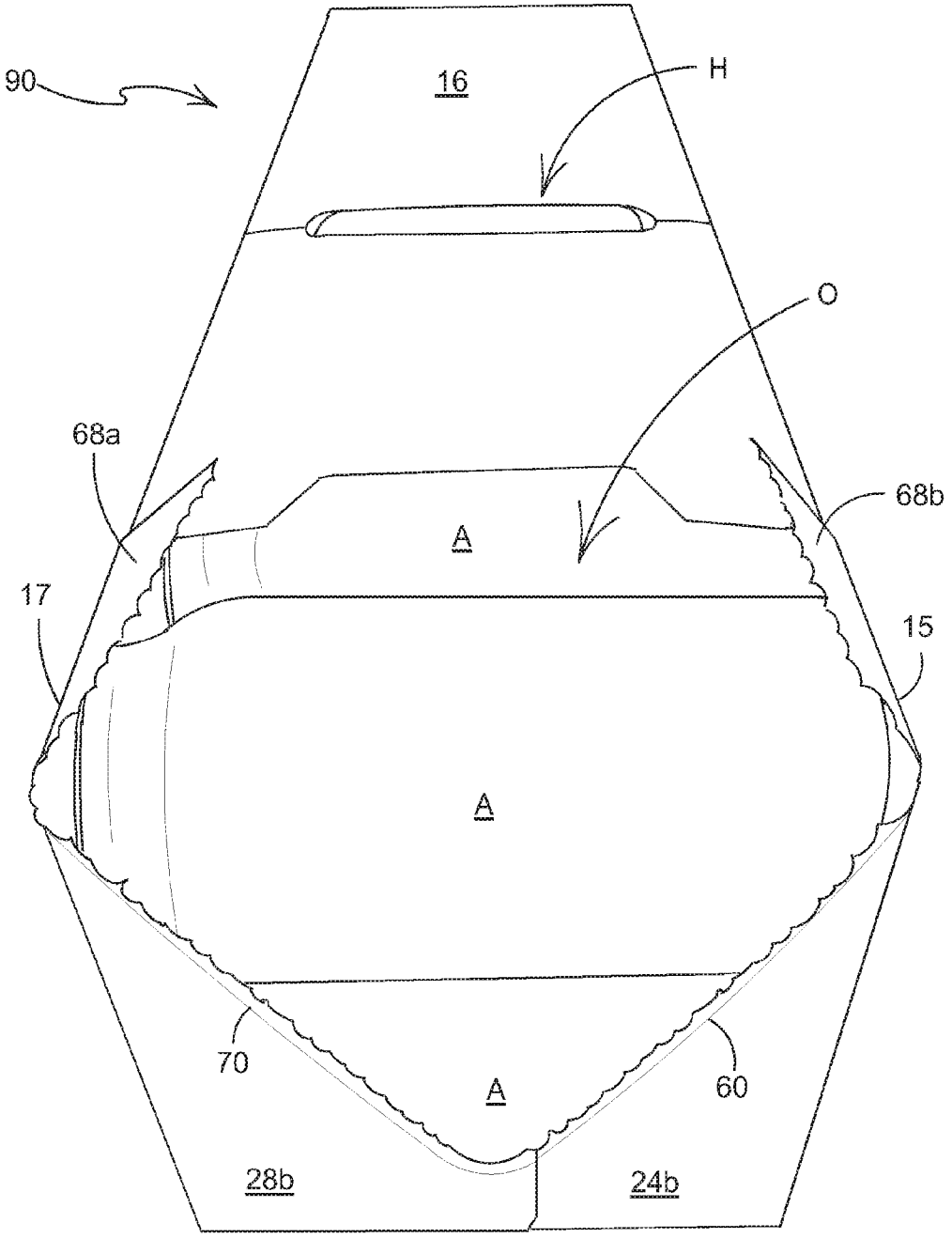
FIGS. 3 to 5 are perspective views from above of the carton of FIG. 2 in which a dispenser is in various stages of deployment.

FIGS. 2 and 3 illustrate the assembled carton 90 forming a package with a plurality of articles A.

Referring to FIGS. 2 to 5 the carton 90 comprises dispenser D disposed in part in the top panel 16, in part in the end wall formed by the sixth and eighth end closure panels 24*b*, 28*b* and in part in the first and second side wall panels 14, 18.

As shown in FIG. 3, when the detachable portion 62/64/66 is removed an opening O is created. The opening O is substantially diamond shaped. A first substantially triangular portion is removed from the top panel 16 and a second substantially triangular portion is removed from the end wall formed from the end closure panels 22*b*, 24*b*, 26*b*, 28*b*. The second substantially triangular portion comprises a portion of the sixth and eighth end closure panels 24*b*, 28*b* and the seventh end closure panel 26*b*. In order that the opening O is dimensioned large enough such that an article A can be withdrawn from the carton 90, the first portion 68*a* of the top panel 16 and the second portion 68*b* of the top panel 16 are folded about fold lines 17, 15 respectively. The first and second portions 68*a*, 68*b* of the top panel 16 may be folded prior to removing an article A from the carton 90. Alternatively, the first and second portions 68*a*, 68*b* of the top panel 16 are folded in response to, or simultaneously with, removal of an article A from the carton 90.

The first and second portions 68*a*, 68*b* of the top panel 16 may be at least partially folded outwardly of the carton 90 when the detachable portion 62/64/66 is removed; the shearing force needed to sever the severance lines 76, 84 may have the effect of displacing the first and second portions 68*a*, 68*b* outwardly of the plane of the top panel 16.

Figure 4:
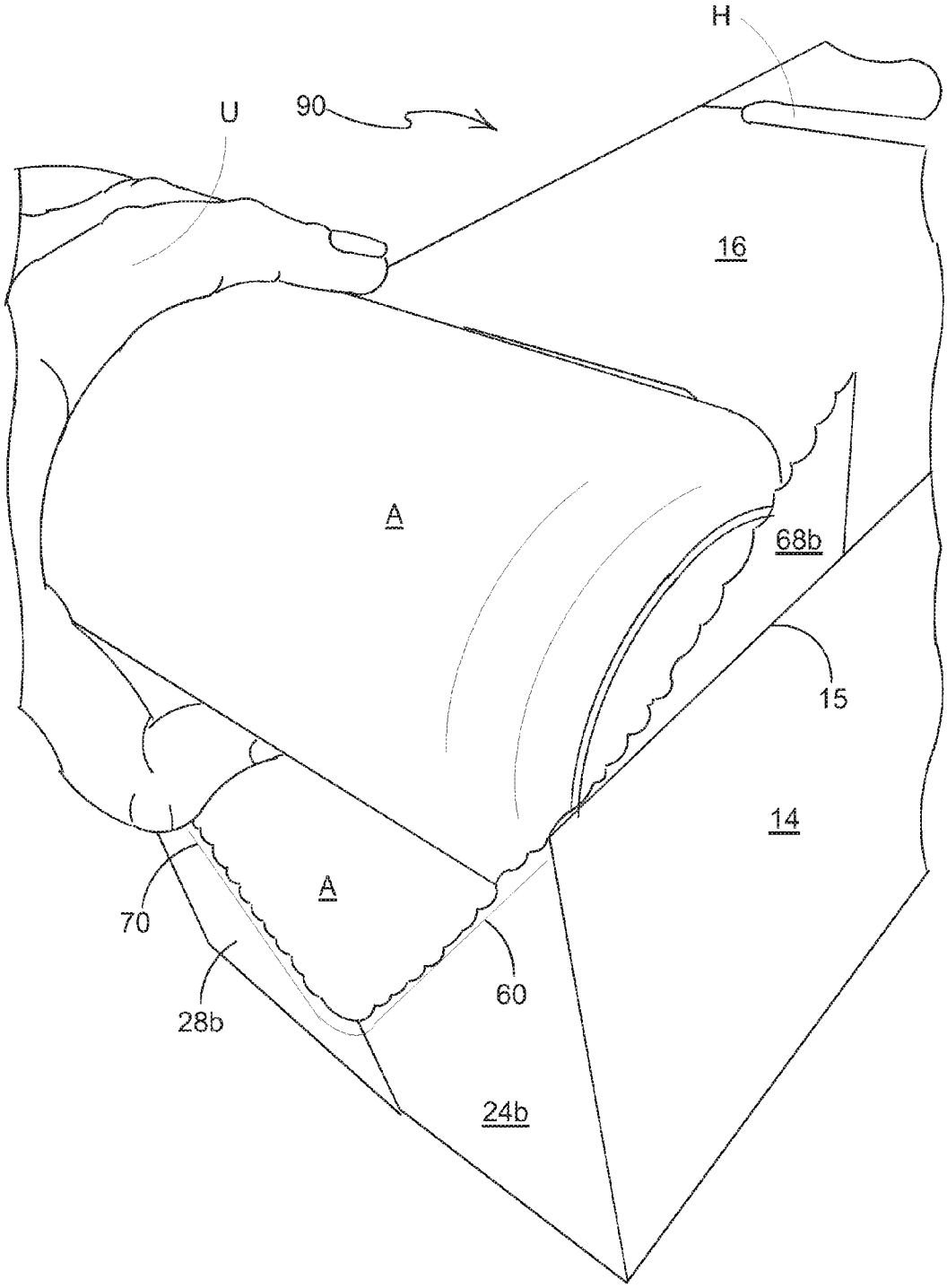
Figure 5:
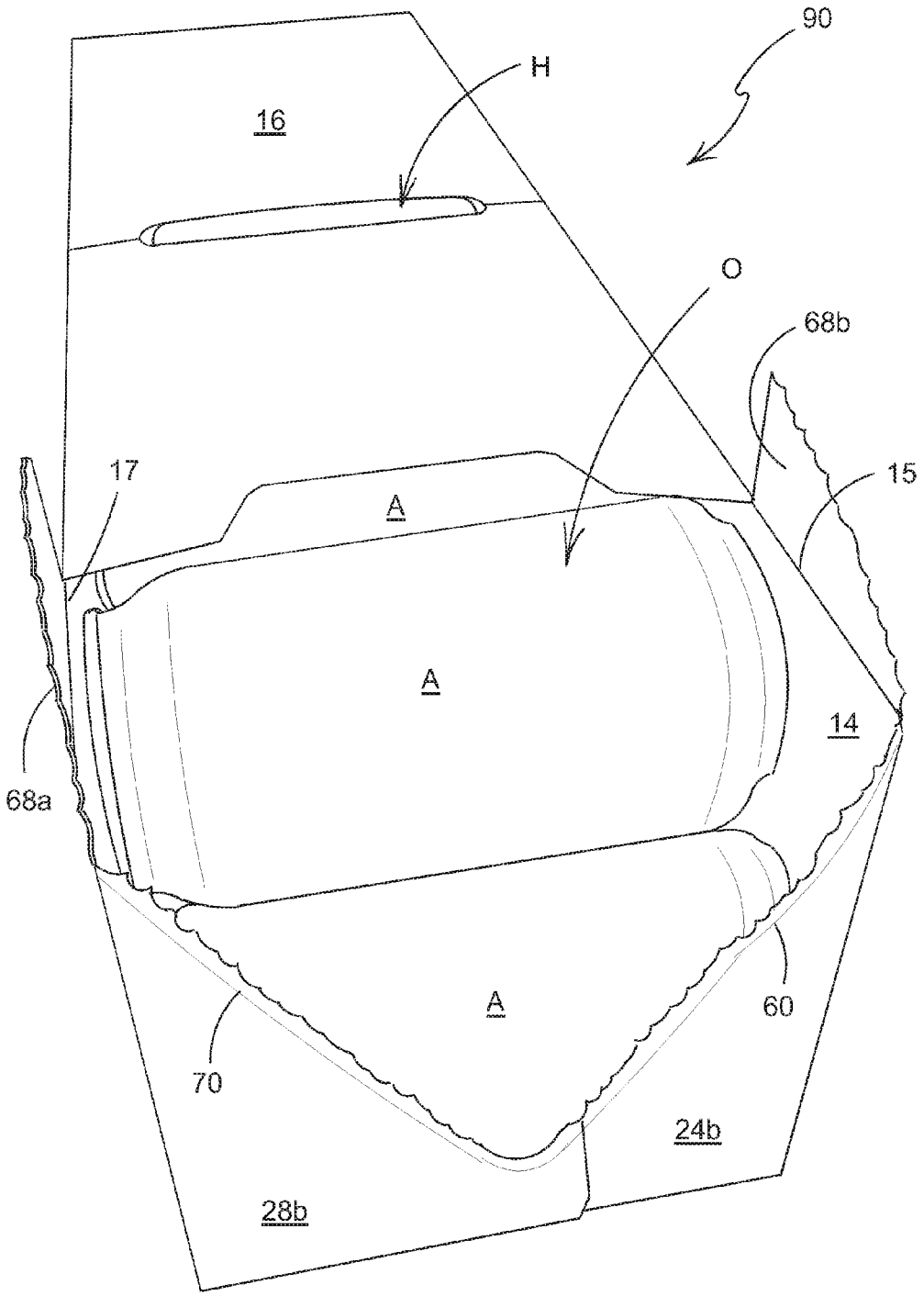

When the first and second portions 68*a*, 68*b* of the top panel 16 are folded outwardly of the carton 90 the portion of the opening defined in the top panel 16 extends across the full width of the top panel 16. The articles A which extend substantially between the first and second side panels 14, 18 can be easily withdrawn as a consequence, as shown in FIGS. 4 and 5.

It can be appreciated that various changes may be made within the scope of the present invention. For example, the size and shape of the panels and apertures may be adjusted to accommodate articles of differing size or shape. The carton 90 may be provided with only one foldable portion 68*a*, 68*b*; an article A may be removed through the opening created in the carton by partially rotating or pivotally moving the article through the opening, the one foldable portion 68*a*, 68*b* may be folded outwardly of the carton 90 in response as the article A is withdrawn.

Whilst the foregoing embodiments have been described with reference to a wraparound style carton it is envisaged that the dispenser may be employed in cartons of alternative design such as, but not limited to, fully enclosed cartons, basket carries and top gripping clips.

It will be recognised that as used herein, directional references such as "top", "base", "front", "back", "end", "side", "inner", "outer", "upper" and "lower" do not limit the respective panels to such orientation, but merely serve to distinguish these panels from one another. Any reference to "hinged connection" should not be construed as necessarily referring to a single fold line only; indeed it is envisaged that a hinged connection can be formed from one or more of the following: a short slit, a frangible line or a fold line, without departing from the scope of the invention. It can be appreciated that various changes may be made within the scope of the present invention. For example, the size and shape of the panels and apertures may be adjusted to accommodate articles of differing size or shape.

As used herein, the terms "hinged connection" and "fold line" each refers to all manner of lines that define hinge features of the blank or substrate of sheet material, facilitate folding portions of the blank or substrate of sheet material with respect to one another, or otherwise indicate optimal panel folding locations for the blank or substrate of sheet material. Any reference to "hinged connection" should not be construed as necessarily referring to a single fold line only; indeed a hinged connection can be formed from one or more fold lines.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforementioned options, without departing from the scope of the invention.

As used herein, the term "severance line" may refer to all manner of lines formed in the blank or substrate of sheet material that facilitate separating portions of the blank or substrate of sheet material from one another, or otherwise that indicate optimal separation locations on the blank or substrate. As used herein, the term "severance line" may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines and severance lines can each include elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking to provide a fold line, to facilitate folding and facilitate breaking with more effort to provide a frangible fold line, or to facilitate breaking with little effort to provide a severance line.

The invention claimed is:

1. A carton for packaging one or more articles, the carton comprising a plurality of panels for forming a tubular structure, the plurality of panels comprising a top panel, a base panel and a pair of first and second opposed side panels hingedly connected to first and second opposite sides of the top and base panels respectively, the carton comprising at least one end closure panel forming an end wall which at least partially closes a first end of the tubular structure, wherein the carton comprises a dispenser for facilitating access to the carton contents, the dispenser comprising a first severance line and a second severance line each defined in one of the plurality of panels forming the tubular structure, and a third severance line and a fourth severance line each defined in the end wall, the first and second severance lines being divergently arranged with respect to each other, and the third and fourth severance lines being divergently arranged with respect to each other, wherein the first severance line and the third severance line converge at a first corner of the one of the plurality of panels forming the tubular structure and the second severance line and the fourth severance line converge at a second corner of the one of the plurality of panels forming the tubular structure, and wherein the top panel is hingedly connected to the first side panel via a first hinged connection, the top panel is hingedly connected to the second side panel via a second hinged connection, the bottom panel is hingedly connected to the first side panel via a third hinged connection, the bottom panel is hingedly connected to the second side panel via a fourth hinged connection, and the at least one end closure panel is hingedly connected to at least one of the top panel, the base panel, and the first and second side panels via a fifth hinged connection, and wherein none of the first, second, third, or fourth severance lines is coincident with any of the first, second, third, fourth, or fifth hinged connections.

2. A carton according to claim 1, wherein the first severance line extends from the first corner of the one of the plurality of panels forming the tubular structure and is divergently arranged with respect to the first hinged connection, the second severance line extends from the second corner of the one of the plurality of panels forming the tubular structure and is divergently arranged with respect to the second hinged connection.

3. A carton according to claim 2, wherein the at least one end closure panel comprises a first end closure panel hinged to the first side panel via the fifth hinged connection, the third severance line extends from a vertex defined by the fifth hinged connection and the first hinged connection and wherein the third severance line is divergently arranged with respect to the first hinged connection.

4. A carton according to claim 3, wherein the at least one end closure panel further comprises a second end closure panel hinged to the second side panel via a sixth hinged connection, the fourth severance line extends from a vertex defined by the sixth hinged connection and the second hinged connection, and wherein the fourth severance line is divergently arranged with respect to the sixth hinged connection.

5. A carton for packaging one or more articles, the carton comprising a plurality of panels for forming a tubular structure, the plurality of panels comprising a top panel and a first side panel hingedly connected to a first side of the top panel, wherein the carton comprises a dispenser for facilitating access to the contents of the carton, the dispenser comprising a detachable portion defined at least in part by a first severance line defined in the top panel, the first severance line being divergently arranged with respect to the hinged connection between the top panel and the first side panel, the dispenser further comprising a second severance line extending between the first severance line and the hinged connection between the top panel and the first side panel, the first and second severance lines defining in part a first portion of the top panel hingedly connected to the first side panel, wherein the detachable portion defines an opening in the carton, the first portion being foldable with respect to the first side panel when the detachable portion is removed from the top panel such that an article can be withdrawn from the carton, wherein the carton further comprises at least one end closure panel hingedly connected to the first side panel and forming an end wall which at least partially closes a first end of the tubular structure, wherein the dispenser further comprises a third severance line and a fourth severance line each defined in the end wall and defining in part the detachable portion, the third severance line and the fourth severance line being divergently arranged with respect to each other, wherein the first severance line and the third severance line each extend from a vertex defined by the hinged connection between the top panel and the first side panel and the hinged connection between the at least one end closure panel and the first side panel.

6. A carton according to claim 5, wherein the carton comprises a second side panel hingedly connected to a second side of the top panel and the dispenser comprises a fifth severance line defined in the top panel, the fifth severance line being divergently arranged with respect to the hinged connection between the top panel and the second side panel, the dispenser further comprising a sixth severance line extending between the fifth severance line and the hinged connection between the top panel and the second side panel, the fifth and sixth severance lines defining in part a second portion of the top panel hingedly connected to the second side panel, and wherein the second portion is foldable with respect to the second side panel when the detachable portion is removed from the top panel thereby enabling an article to be withdrawn from the carton.

7. A blank for forming a carton, the blank comprising a plurality of panels for forming a tubular structure, the plurality of panels comprising a top panel, a base panel and a pair of first and second opposed side panels, the blank comprising at least one end closure panel for forming an end wall which in a set-up carton at least partially closes a first end of the tubular structure, wherein the blank comprises a dispenser for facilitating access to an interior of the set-up carton, the dispenser comprising a first severance line and a second severance line each defined in one of the plurality of panels forming the tubular structure and a third severance line and a fourth severance line each defined in the end wall, the first and second severance lines being divergently arranged with respect to each other, the third and fourth severance lines being divergently arranged with respect to each other, wherein the first severance line and the third severance line converge at a first corner of the one of the plurality of panels forming the tubular structure and the second severance line and the fourth severance line converge at a second corner of the one of the plurality of panels forming the tubular structure, and wherein the top panel is hingedly connected to the first side panel via a first hinged connection, the top panel is hingedly connected to the second side panel via a second hinged connection, the bottom panel is hingedly connected to the first side panel via a third hinged connection, the bottom panel is hingedly connected to the second side panel via a fourth hinged connection, and the at least one end closure panel is hingedly connected to at least one of the top panel, the base panel, and the first and second side panels via a fifth hinged connection, and wherein none of the first, second, third, or fourth severance lines is coincident with any of the first, second, third, fourth, or fifth hinged connections.

* * * * *